US011172283B2

(12) United States Patent
Igarashi et al.

(10) Patent No.: US 11,172,283 B2
(45) Date of Patent: Nov. 9, 2021

(54) SOUND OUTPUT DEVICE

(71) Applicant: SONY CORPORATION, Tokyo (JP)

(72) Inventors: Go Igarashi, Tokyo (JP); Satoshi Suzuki, Kanagawa (JP); Naoki Shinmen, Tokyo (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 16/463,639

(22) PCT Filed: Oct. 13, 2017

(86) PCT No.: PCT/JP2017/037274
§ 371 (c)(1),
(2) Date: May 23, 2019

(87) PCT Pub. No.: WO2018/123210
PCT Pub. Date: Jul. 5, 2018

(65) Prior Publication Data

US 2019/0320256 A1 Oct. 17, 2019

(30) Foreign Application Priority Data

Dec. 29, 2016 (JP) ..... JP2016-257284

(51) Int. Cl.
*H04R 1/10* (2006.01)
*H04R 5/033* (2006.01)
*H04R 1/28* (2006.01)

(52) U.S. Cl.
CPC ..... *H04R 1/105* (2013.01); *H04R 1/1016* (2013.01); *H04R 1/1058* (2013.01);
(Continued)

(58) Field of Classification Search
CPC ..... H04R 1/10; H04R 1/1016; H04R 1/105; H04R 1/1058; H04R 1/1066;
(Continued)

(56) References Cited

U.S. PATENT DOCUMENTS 4,742,887 A * 5/1988 Yamagishi ..... H04R 1/2857 181/129
5,949,896 A * 9/1999 Nageno ..... H04R 1/1016 381/328

(Continued)

FOREIGN PATENT DOCUMENTS

EP 2259556 A1 12/2010
JP 2006-526295 A 11/2006

(Continued)

OTHER PUBLICATIONS

Extended European Search Report of EP Application No. 17887736.1, dated Nov. 21, 2019, 08 pages.

(Continued)

*Primary Examiner* — Yogeshkumar Patel
(74) *Attorney, Agent, or Firm* — Chip Law Group

(57) ABSTRACT

To provide an excellent sound output device which is worn on an ear of a user and used. The sound output device includes a sound generation part and a holding part that has an opening portion and holds the sound generation part in the vicinity of an entrance of an ear canal of a user. The holding part includes a ring body having the opening portion, and a housing of the sound generation part is integrated with a part of the ring body. The sound generation part includes a sound generation element having a dynamic type driver, and has a hollow exhaust part joining with a rear surface of the housing of the sound generation part. The exhaust part extends from a rear surface side of the housing across an intertragic notch and has an exhaust hole outside an auricle.

8 Claims, 11 Drawing Sheets

(52) U.S. Cl.
CPC ..... *H04R 1/1066* (2013.01); *H04R 1/2819* (2013.01); *H04R 1/2826* (2013.01); *H04R 5/0335* (2013.01); *H04R 1/2815* (2013.01); *H04R 1/2823* (2013.01); *H04R 2460/09* (2013.01); *H04R 2460/11* (2013.01)

(58) Field of Classification Search
CPC ..... H04R 5/0335; H04R 2460/09; H04R 2460/11; H04R 1/2815; H04R 1/2819; H04R 1/2823; H04R 1/2826
USPC ..... 381/328, 349, 350, 373, 374, 380
See application file for complete search history.

(56) References Cited

U.S. PATENT DOCUMENTS

| | | | | |
|---|---|---|---|---|
| 8,712,087 | B2 * | 4/2014 | Ozawa | H04R 1/345 181/130 |
| 10,182,281 | B2 | 1/2019 | Igarashi et al. | |
| 10,237,641 | B2 | 3/2019 | Igarashi et al. | |
| 10,623,842 | B2 | 4/2020 | Igarashi et al. | |
| 2007/0105598 | A1 | 5/2007 | Varming | |
| 2013/0343593 | A1 * | 12/2013 | Howes | H04R 1/023 381/380 |
| 2014/0286515 | A1 | 9/2014 | Bone et al. | |
| 2014/0307911 | A1 | 10/2014 | Inoda | |
| 2015/0110320 | A1 * | 4/2015 | Liu | H04R 1/1016 381/322 |
| 2015/0110330 | A1 | 4/2015 | Howes et al. | |
| 2016/0277837 | A1 | 9/2016 | Sato et al. | |
| 2017/0311070 | A1 * | 10/2017 | Igarashi | H04R 1/1066 |
| 2019/0373354 | A1 * | 12/2019 | Sondergaard | H04R 1/1058 |

FOREIGN PATENT DOCUMENTS

| | | | | |
|---|---|---|---|---|
| JP | 4709017 | B2 | 6/2011 | |
| JP | 2014-014074 | A | 1/2014 | |
| JP | 2014-014974 | A | 1/2014 | |
| JP | 2014-207617 | A | 10/2014 | |
| WO | 2015/068756 | A1 | 5/2015 | |
| WO | 2016/036922 | A1 | 3/2016 | |
| WO | 2016/063462 | A1 | 4/2016 | |
| WO | WO-2016067700 | A1 * | 5/2016 | H04R 1/1016 |

OTHER PUBLICATIONS

International Search Report and Written Opinion of PCT Application No. PCT/JP2017/037274, dated Nov. 21, 2017, 10 pages of ISRWO.

Office Action for CN Patent Application No. 201780079764.6, dated Apr. 2, 2020, 07 pages of Office Action and 09 pages of English Translation.

Office Action for IN Patent Application No. 201917024725, dated Jun. 24, 2021, 05 pages of Office Action.

Office Action for EP Patent Application No. 17887736.1, dated Jul. 14, 2021, 06 pages of Office Action.

* cited by examiner

SOUND OUTPUT DEVICE

CROSS REFERENCE TO RELATED APPLICATIONS

This application is a U.S. National Phase of International Patent Application No. PCT/JP2017/037274 filed on Oct. 13, 2017, which claims priority benefit of Japanese Patent Application No. JP 2016-257284 filed in the Japan Patent Office on Dec. 29, 2016. Each of the above-referenced applications is hereby incorporated herein by reference in its entirety.

TECHNICAL FIELD

The technology disclosed in the present specification relates to a sound output device which is worn on an ear of a user and used.

BACKGROUND ART

Small sound conversion devices in which a speaker closely placed over an ear or an eardrum converts electrical signals outputted from a reproducing device or a receiver to sound signals, namely, earphones, have come into widespread use. A sound reproducing device of this kind is used in various environments because the sound reproducing device outputs a sound to be heard only by a user wearing the sound reproducing device.

Many of the earphones currently widely used are shaped to be put into the ear of the user. For example, an inner-ear type earphone is shaped to be hooked on an auricle of the user. In addition, a canal type earphone is shaped to be deeply put into an ear cavity (ear canal) and used, often configured to be hermetically sealed, and offers a relatively good sound insulation performance, which provides an advantage that the user can enjoy music even in a place with somewhat loud noise.

The canal type earphone commonly has, as basic configuration elements, a speaker unit for converting electrical signals to sound signals and a substantially cylindrical housing (casing) serving also as a sound tube. The speaker unit is attached to one end of the housing (outside the ear canal). The housing has an emission outlet through which aerial vibrations generated in the speaker unit are emitted to the ear canal to be transmitted to the eardrum. In addition, an earpiece (removable part), which has a profile corresponding to the ear canal when the user wears the earpiece, is usually attached to the other end of the housing (insertion part of the ear canal). For example, a canal type earphone device has been proposed in which a sound tube is disposed at an angle from a position deviated from a center of the housing, which allows the housing to be accommodated into a cavum concha and the sound tube to be disposed up to the entrance of the ear canal (refer to, for example, Patent Literature 1).

Even while wearing the earphone to listen to audio provided, the user also needs to listen to an ambient sound at the same time, for example, when people around the user speak to the user. However, concerning most of conventional earphones such as the canal type earphone, it is extremely difficult for the user to listen to the ambient sound in the fitting state of the earphone. This is because, from the viewpoint of improvement in reproduced sound quality, prevention of leakage of the reproduced sound to the outside, and so on, the conventional earphones are configured to close the ear cavity substantially completely. For example, in indoor and outdoor sports such as walking, jogging, cycling, mountain climbing, skiing, and snowboarding, in driving, or in navigation, a situation in which the user is not able to listen to the ambient sound is dangerous. In addition, in communication or presentation, a situation in which the user is not able to listen to the ambient sound leads to a reduced service.

Further, to the people around the user, the conventional earphones appear to close the ear cavity of the user wearing the earphone. This gives the impression that it is hard to speak to the wearer of the earphone, which inhibits communication between people.

CITATION LIST

Patent Literature

Patent Literature 1: JP 4709017B

DISCLOSURE OF INVENTION

Technical Problem

An object of the technology disclosed in the present specification is to provide an excellent sound output device which is worn on an ear of a user and used.

Solution to Problem

A technology disclosed in the present description, which is made in view of the aforementioned problem, is a sound output device including: a sound generation part; and a holding part that includes a sound transmission part and is configured to hold the sound generation part in a vicinity of an entrance of an ear canal of a user.

The sound transmission part includes a structure having an opening portion. In addition, a housing of the sound generation part is integrated with a part of the structure having the opening portion. Engagement with an intertragic notch of the user makes the sound output device fit in an ear of the user.

In addition, the sound generation part includes a sound generation element having a dynamic type driver. A hollow exhaust part joins with a rear surface of the housing of the sound generation part, and the hollow exhaust part emits a high air pressure generated in a back cavity of the driver (sound having a phase opposite to that in the front cavity) to the outside. The exhaust part is used also as a duct through which to insert a signal line, extends from a rear surface side of the housing across an intertragic notch, and has an exhaust hole outside an auricle.

Advantageous Effects of Invention

According to the technology disclosed in the present specification, an excellent ear cavity open type sound output device which is worn on an ear of a user and used can be provided.

Note that the effects described in the present specification are merely examples, and effects of the present invention are not limited to these. Further, there is also a case where the present invention further provides additional effects other than the above-described effects.

Other objects, features and advantages of the technology disclosed in the present specification will become more clear from the detailed description based on an embodiment which will be described later and the accompanying drawings.

MODE(S) FOR CARRYING OUT THE INVENTION

Figure 1:
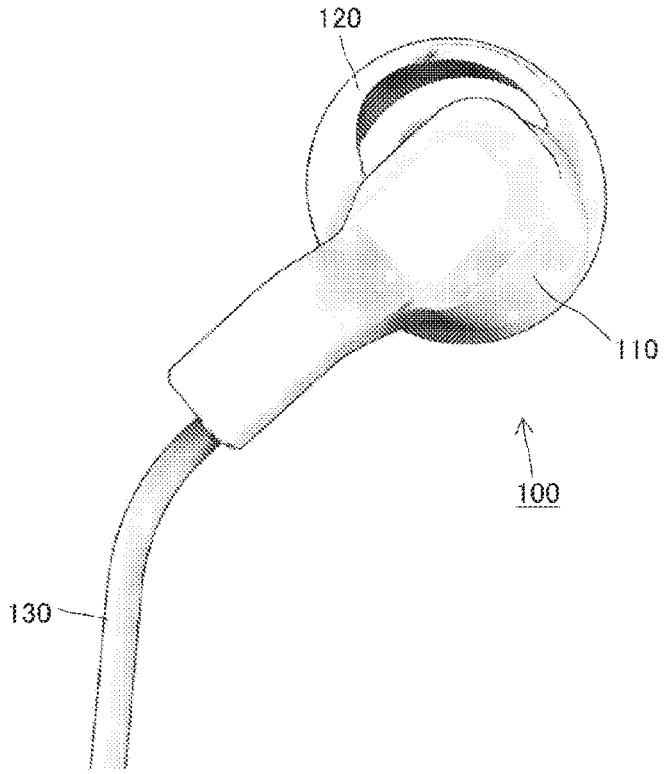
FIG. 1 is a diagram illustrating the external configuration of a sound output device 100.
Figure 2:
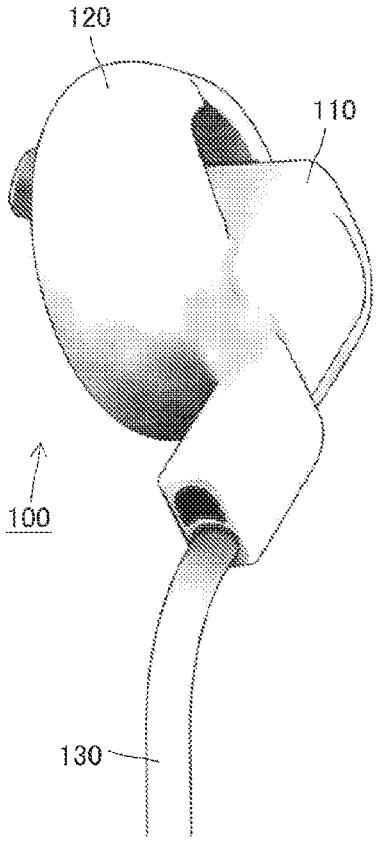
FIG. 2 is a diagram illustrating the external configuration of the sound output device 100.
Figure 3:
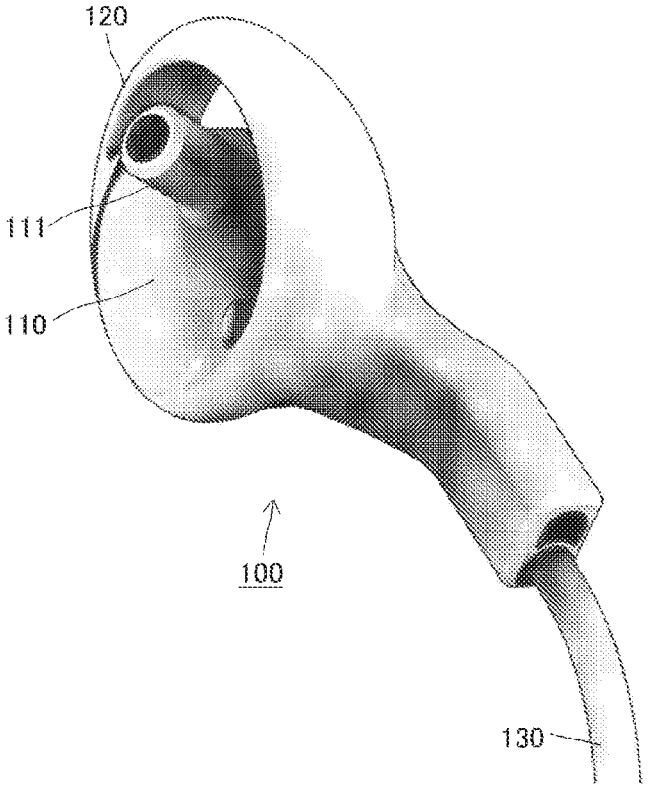
FIG. 3 is a diagram illustrating the external configuration of the sound output device 100.
Figure 4:
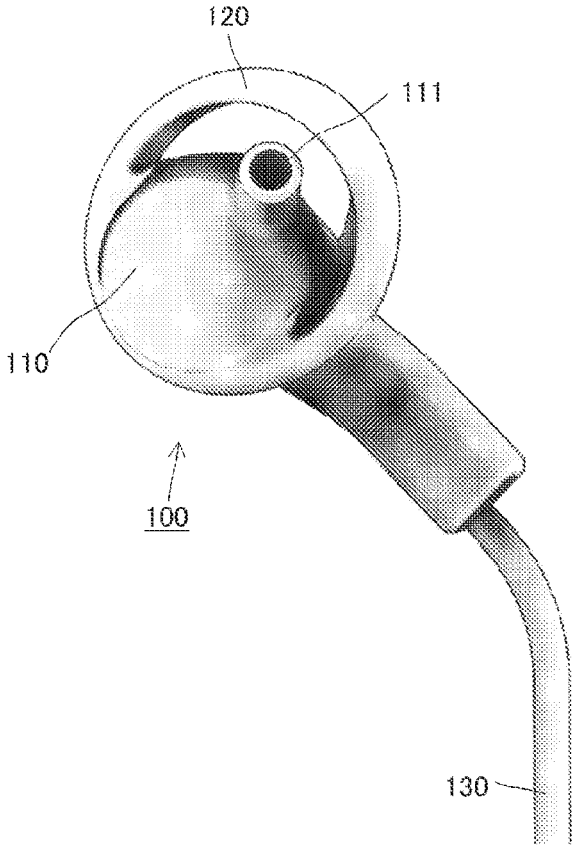
FIG. 4 is a diagram illustrating the external configuration of the sound output device 100.

An embodiment of the technology disclosed in the present specification will be described below with reference to the drawings.

FIG. 1 to FIG. 4 illustrate the appearance of a sound output device 100 to which the technology disclosed in the present specification is applied, while changing the direction of viewing. Although FIG. 1 to FIG. 4 show only one of the left and right sound output devices 100, it should be understood that a set of the left and right sound output devices 100 fit in the left and right ears of a user to implement stereo reproduction or the like.

The sound output device 100 includes a sound generation part 110 and a holding part 120 for supporting the sound generation part 110. Further, the sound generation part 110 contains a built-in sound generation element for generating a sound in a housing thereof, and has a short and hollow tubular sound guide part 111 protruding from a front surface (side surface facing toward the entrance of an ear canal when fitting in an auricle) of the housing.

The sound generation part 110 includes the sound generation element (described later) for causing a sound pressure change such as a dynamic type driver having a diameter of approximately 9 millimeters, and the housing thereof is integrated with a part of the holding part 120. In the example shown in FIG. 1 or the like, the housing of the sound generation part 110 joins with an inner surface of the holding part 120; however, it is also conceivable to design the housing of the sound generation part 110 so as to join with an outer surface of the holding part 120, or to join with the holding part 120 in the vicinity of the center of the housing of the sound generation part 110 because the housing of the sound generation part 110 is compact.

The sound guide part 111 includes a hollow tube member which protrudes from the front surface of the sound generation part 110 (front surface side of a diaphragm (described later) disposed in the housing) in the direction of the entrance of the ear canal. An opening portion at the tip of the sound guide part 111 serves as a sound output hole. The sound guide part 111 outputs a sound generated by the sound generation part 110 toward the entrance of the ear canal.

Figure 13:
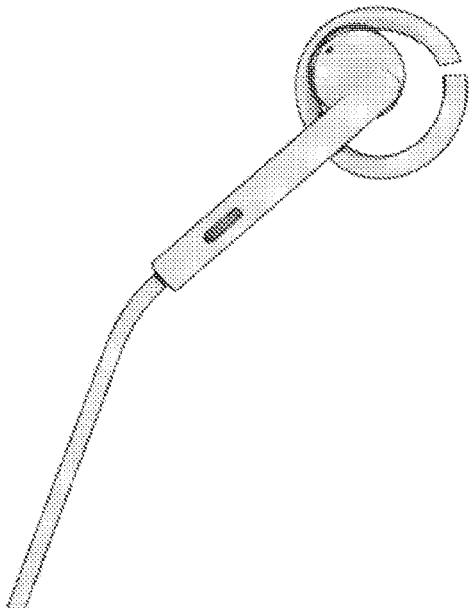
FIG. 13 is a diagram illustrating the external configuration of a sound output device having a C-shaped holding part.

The holding part 120 has a sound transmission part. In the examples shown in FIG. 1 to FIG. 4, the holding part 120 is structured to have an opening portion, and the opening portion corresponds to the sound transmission part. Therefore, even in a state where the holding part 120 is inserted into a cavum concha of the user, an ear cavity of the user is not closed. It can be therefore said that the ear cavity of the user is open, the sound output device 100 is of an ear cavity open type, and has a sound transmission performance. In the example shown in FIG. 1 or the like, the holding part 120 has a shape such as a closed O-ring with no cut portion (hereinafter also referred to as an "O-shape" simply) regardless of whether or not there is a straight line portion and a curve portion. However, as shown in FIG. 13, the holding part may have an open C-shape with a cut portion (hereinafter also referred to as a "C-shape" simply) regardless of whether or not there is a straight line portion and a curve portion and may have a shape so as to be engaged with the cavum concha.

Figure 5:
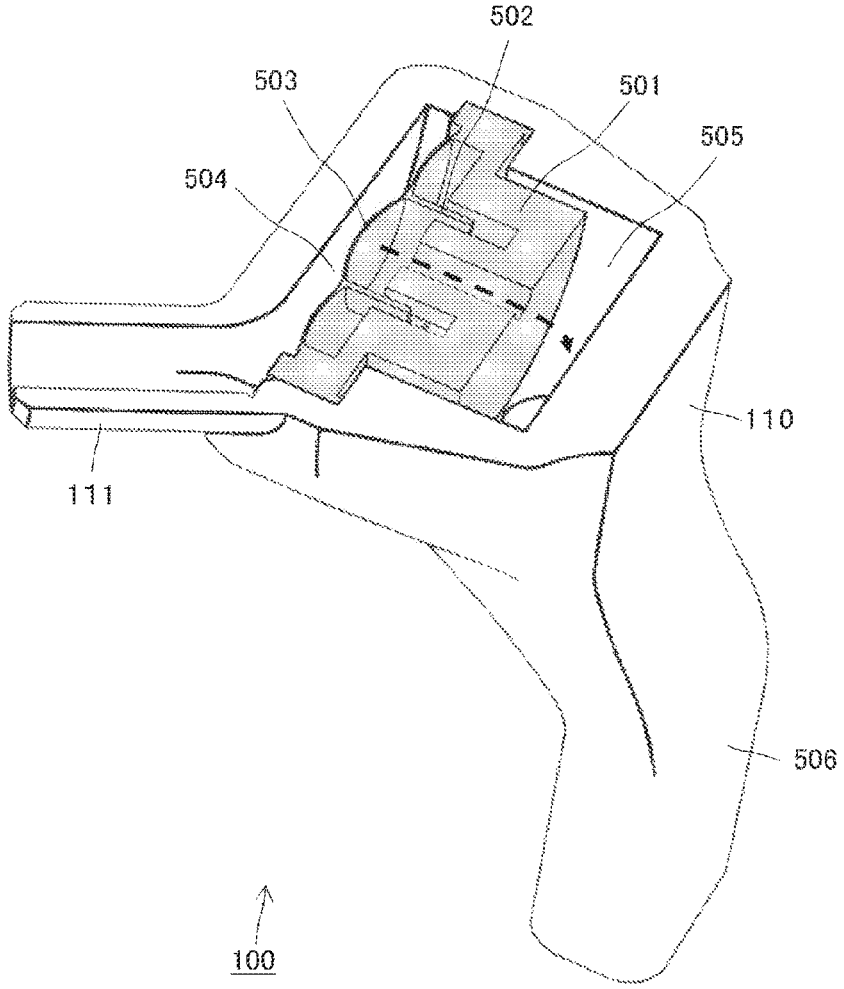
FIG. 5 is a diagram illustrating the internal configuration of the sound generation part 110.
Figure 6:
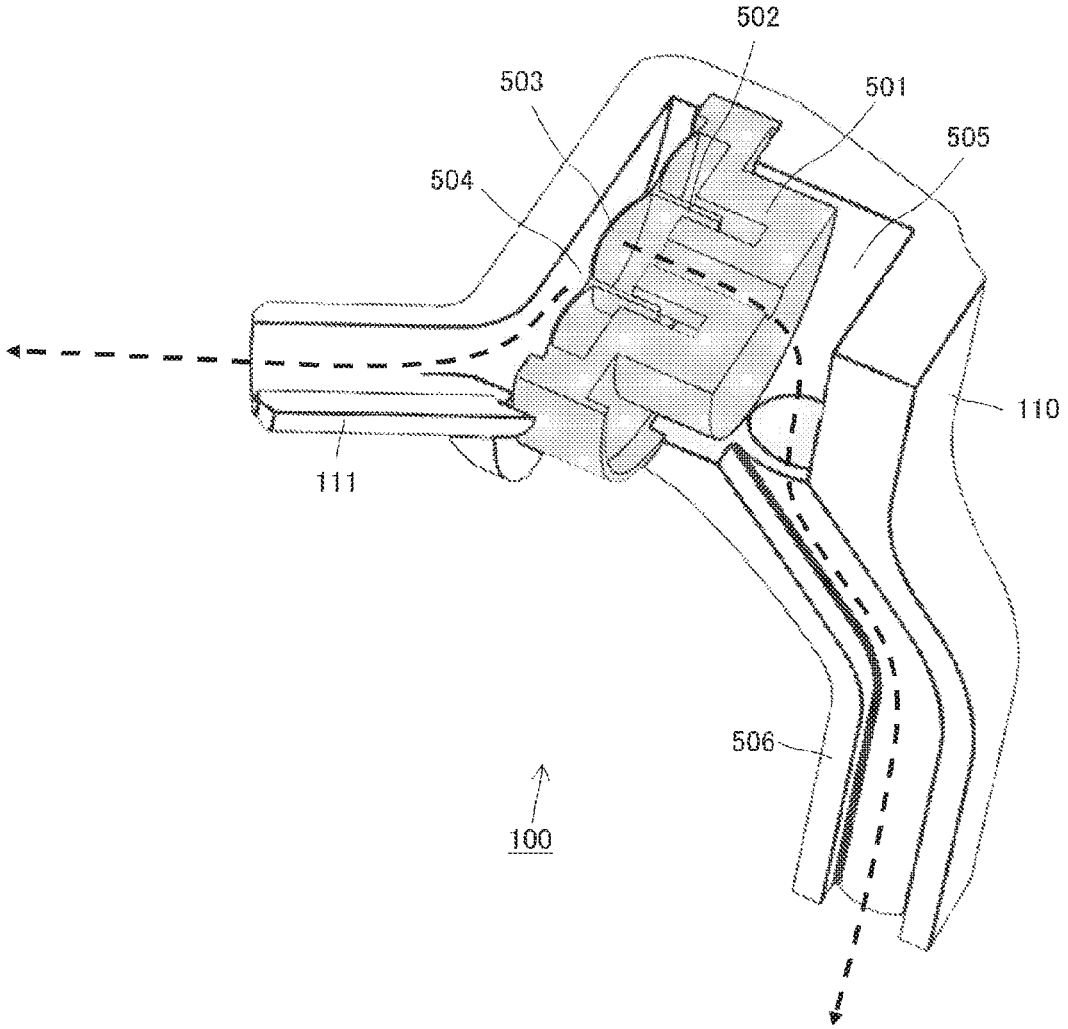
FIG. 6 is a diagram illustrating the internal configuration of the sound generation part 110.

FIG. 5 and FIG. 6 are cross-sectional views of the sound generation part 110, and show the internal configuration of the housing thereof. Note that FIG. 5 mainly shows a cross section of a sound output part, and FIG. 6 shows a cross section including an exhaust part (described later). For simplification of the drawings, the illustration of the holding part 120 is omitted.

Inside the sound generation part 110, a diaphragm 503 having a voice coil 502 is disposed so as to face an interior of a magnetic circuit including a magnet 501. Further, the diaphragm 503 partitions the inside of the sound generation part 110 into a diaphragm front space (front cavity) 504 and a diaphragm rear space 505 (back cavity). In a case where the magnetic field changes according to audio signals inputted to the voice coil 502 via a signal line (not shown), the magnetic force of the magnet 501 causes the diaphragm 503 to move back and forth (the winding direction of the voice coil 502); thereby, a change in air pressure occurs between the diaphragm front space 504 and the diaphragm rear space 505, which becomes a sound.

The sound generated in the diaphragm front space 504 propagates inside a tube of a sound guide part 1651 and is emitted from the sound output hole of the tip thereof toward the depth of the ear canal, and thereafter, reaches an eardrum of the user.

Meanwhile, in order that the sound generated in the diaphragm rear space 505 (sound having a phase opposite to that of the diaphragm front space 504) does not interfere with the vibration of the diaphragm 503, an exhaust hole for emitting the sound to the outside of the housing of the sound generation part 110 is necessary.

It is assumed that a sound pickup device 1600 including the sound generation part 110 fits in the cavum concha of the user and is used (see below and FIG. 7). If the exhaust hole is drilled, for example, on the rear surface of the housing of the sound generation part 110, then the sound generated in the diaphragm rear space 505 is emitted in the cavum concha, which becomes a large noise for a reproduced sound generated in the sound generation part 110.

To cope with this, as shown in FIG. 5 and FIG. 6, an exhaust part 506 is provided on the rear surface side of the sound generation part 110 (diaphragm 503). The exhaust part 506 includes a hollow tube member having a sufficient length to extend from the rear surface side of the housing of the sound generation part 110 across an intertragic notch to reach the outside of the auricle. An opening portion at the tip of the exhaust part 506 serves as an exhaust hole for emitting the sound generated in the diaphragm rear space 505. With this configuration, the exhaust part 506 can emit the sound generated in the diaphragm rear space 505 to the outside of the auricle, which reduces an influence of sound leakage. In addition, the exhaust part 506 may also serve as a duct through which to insert a signal line 130 (see FIG. 1 to FIG. 4) for audio signals, power, and so on.

Although the sound generation element shown in FIG. 5 and FIG. 6 is a dynamic type driver, the sound generation element may be an electrostatic type driver for causing a sound pressure change in a similar manner. Alternatively, it is also possible to use a sound generation element which is completely different in type, such as a balanced-armature type or a piezoelectric type, or a hybrid type combining a plurality of types of sound generation elements.

Figure 7:
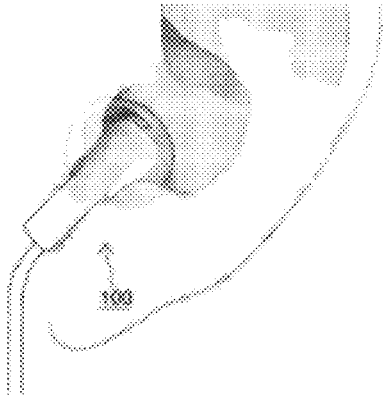
FIG. 7 is a diagram illustrating a state in which the sound output device 100 is worn on the left ear of a user.
Figure 8:
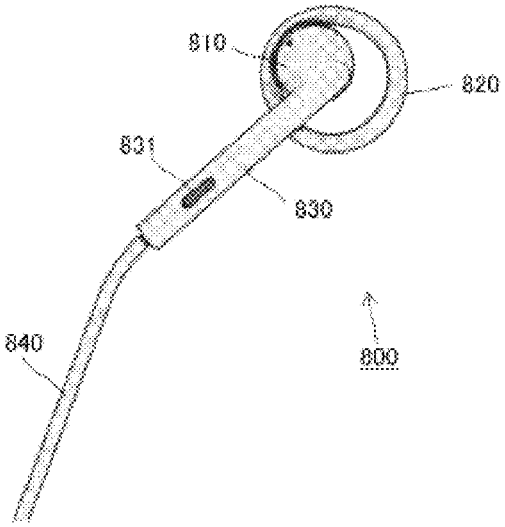
FIG. 8 is a diagram illustrating the external configuration of a sound output device 800.
Figure 9:
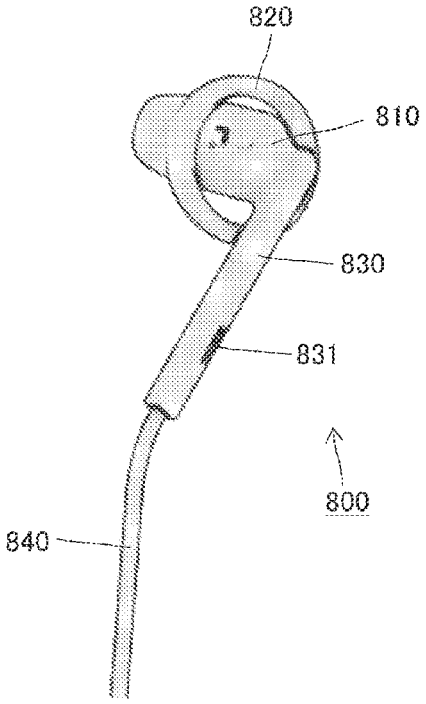
FIG. 9 is a diagram illustrating the external configuration of the sound output device 800.
Figure 10:
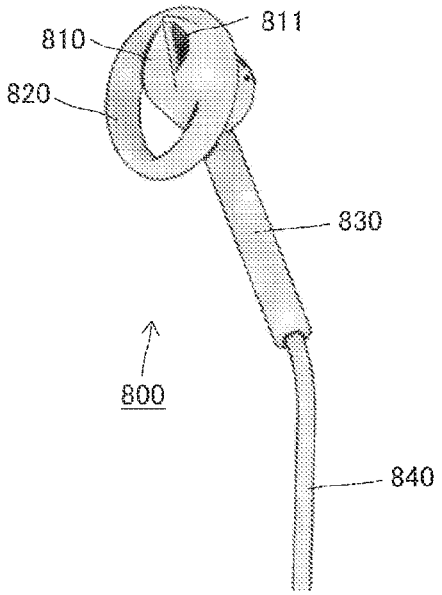
FIG. 10 is a diagram illustrating the external configuration of the sound output device 800.
Figure 11:
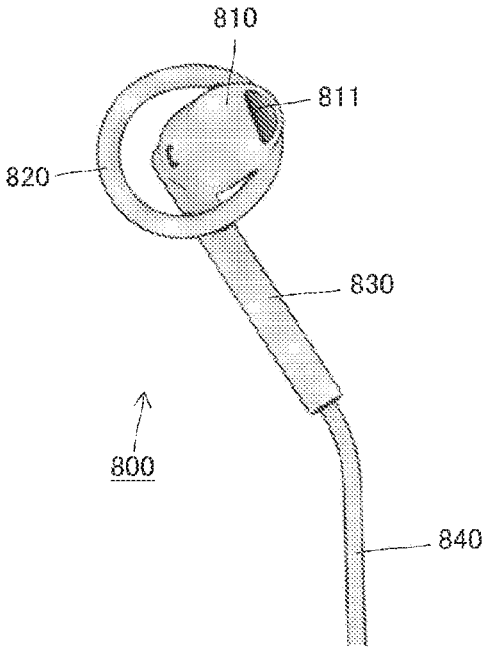
FIG. 11 is a diagram illustrating the external configuration of the sound output device 800.

FIG. 7 shows a state in which the sound output device 100 is worn on the left ear of the user. It should be understood that, even in a case where the sound generation part 110 is configured integrally with the holding part 120, the entire sound output device 100 can fit in the cavum concha of the user because the sound generation part 110 is small with a diameter of approximately 9 millimeters.

In the example shown in FIG. 7, the holding part 120 having a hollow structure with an O-shape is inserted into the cavum concha together with the integrated sound generation part 110, and is in contact with the bottom surface of the cavum concha (the holding part 120 may have a C-shape instead of the O-shape). In addition, the exhaust part 506 protruding from the rear surface of the housing of the sound generation part 110 extends across a valley of the intertragic notch. The holding part 120 is locked to the intertragic notch or an inner wall of a tragus so that the exhaust part 506 is hooked on the valley of the intertragic notch. Thereby, the sound output device 100 suitably fits in the auricle.

The holding part 120 is, for example, approximately 13.5 millimeters in dimension and can fit in the cavum concha of the user. Although the size of the cavum concha varies from person to person, if the outer diameter (or width) of the holding part 120 is set to be larger than 16 millimeters, then many people are not able to insert the holding part 120 into the cavum concha.

In addition, it is preferable that the inner diameter of the exhaust part 506 be as large as possible, in view of an object to emit an unnecessary sound (sound, generated in the back cavity, having a phase opposite to that of the front cavity) to the outside of the housing of the sound generation part 110 and the use of the exhaust part 506 as the duct for the signal line. Meanwhile, as shown in FIG. 7, the exhaust part 506 extends across the valley of the intertragic notch. Therefore, if the outer diameter of the exhaust part 506 is set to be greater than or equal to a gap of the intertragic notch (for example, 3.6 millimeters), then the valley of the intertragic notch is widened, which causes concern that the ear of the user is given a pressing feeling.

As shown in FIG. 7, in a state where the holding part 120 inserted into the cavum concha is locked to the intertragic notch or the inner wall of the tragus, the sound guide part 111 protrudes from the front surface of the housing (front cavity) of the sound generation part 110 so that the sound output hole at the tip of the sound guide part 111 is oriented toward the entrance of the ear canal, which is hidden in FIG. 7.

The sound generated in the sound generation element of the sound generation part 110 is emitted toward the depth of the ear canal from the sound output hole at the tip of the sound guide part 111 protruding from the front surface of the housing of the sound generation part 110, and then the sound reaches the eardrum.

The holding part 120 has a hollow structure, and almost all of the inner side thereof is the opening portion through which to transmit the sound. Since being integrated with a part of the holding part 120, the housing of the sound generation part 110 does not interfere at all with the opening portion of the inner side of the holding part 120. Thus, even in a state where the entire sound output device 100 is inserted into the cavum concha, the ear cavity of the user is not closed. It can be therefore said that the ear cavity of the user is open, the sound output device 100 is of an ear cavity open type, and has a sound transmission performance.

Since the sound generation part 110 is disposed in the cavum concha, a sufficient sound quality can be obtained in the sound output hole at the tip of the sound guide part 111 even if the output of the sound generation part 110 is reduced. It is therefore possible to prevent leakage of the sound generated in the sound generation part 110 to the outside.

In addition, the directivity of the aerial vibration emitted from the tip of the sound guide part 111 also contributes to prevention of sound leakage. The aerial vibration is emitted from the tip of the sound guide part 111 toward the inside of the ear canal. The ear canal is a cylindrical closed space of an S-shaped curve, and typically has a length of approximately 25 to 30 millimeters. The aerial vibration emitted from the tip of the sound guide part 111 toward the depth of the ear canal reaches the eardrum with directivity, and the aerial vibration is partly reflected. In addition, since the sound pressure of the aerial vibration increases in the ear canal, the sensitivity (gain) of, particularly, a low frequency range is improved. On the other hand, the outside of the ear canal, namely, the external environment, is an open space. Thus, in a case where the aerial vibration emitted from the tip of the sound guide part 111 to the outside of the ear canal is released to the external environment, the aerial vibration does not have the directivity and is steeply attenuated. In a state where the holding part 120 is locked to the intertragic notch, it is preferable that the tip of the sound guide part 111, serving as the sound output hole, face the cavum concha rather than the vicinity of the entrance of the ear canal.

FIG. 8 to FIG. 11 show the appearance of a sound output device 800 according to another configuration example, while changing the direction of viewing. Although FIG. 8 to FIG. 11 show only one of the left and right sound output devices 100, it should be understood that a set of the left and right sound output devices 800 fit in the left and right ears of the user to implement stereo reproduction or the like.

The sound output device 800 includes a sound generation part 810 and a holding part 820 for supporting the sound generation part 810. Further, the sound generation part 810 contains a built-in sound generation element for generating a sound in a housing thereof, and has a sound output hole 811 drilled on a front surface (side surface facing toward the entrance of the ear canal when fitting in the auricle) of the housing. The sound output hole 811 has a crescent shape and outputs a sound generated.

The sound generation part 810 includes the sound generation element (described above) for causing a sound pressure change such as a dynamic type driver having a diameter of approximately 6 millimeters, and the housing thereof is integrated with a part of the holding part 820. The illustration and detailed description of the internal configuration of the sound generation part 810 are omitted. The sound generation element is basically a dynamic type driver; however, the sound generation element may be an electrostatic type driver for causing a sound pressure change in a similar manner. Alternatively, it is also possible to use a sound generation element which is completely different in type, such as a balanced-armature type or a piezoelectric type, or a hybrid type combining a plurality of types of sound generation elements.

In the example shown in FIG. 8 to FIG. 11, the housing of the sound generation part 110 integrates with an inner surface of the holding part 820; however, it is also conceivable to design the housing so as to integrate with an outer surface of the holding part 820, to integrate with the holding part 820 in the vicinity of the center of the housing of the sound generation part 810 because the housing is compact.

The holding part 820 has a hollow structure with an O-shape or a C-shape, and almost all of the inner side thereof is an opening portion so that the holding part 820 is capable of functioning as a sound transmission part. In the illustrated example, the holding part 820 includes an O-shaped ring. Thus, even in a state where the holding part 820 is inserted into the cavum concha of the user, the ear cavity of the user is not closed. It can be therefore said that the ear cavity of the user is open, the sound output device 800 is of an ear cavity open type, and has a sound transmission performance.

A duct 830 through which to insert a signal line 840 for audio signals, power, and so on is coupled to the rear surface side of the housing of the sound generation part 810. In a case where the sound generation part 810 is a sound generation element for causing an air pressure change such as a dynamic type driver or an electrostatic type driver, it is necessary to discharge a sound having a phase opposite to that of the front cavity generated in the housing (back cavity) to the outside of the housing, in such a case, the duct 830 can be used also as the exhaust part. An exhaust hole 831 for emitting such a sound is drilled, on the duct 830, in a location away from the holding part 820. Since the exhaust hole 831 is sufficiently away from the sound output hole 811, the exhaust hole 831 does not make a noise for a reproduced sound of the sound generation part 810.

Figure 12:
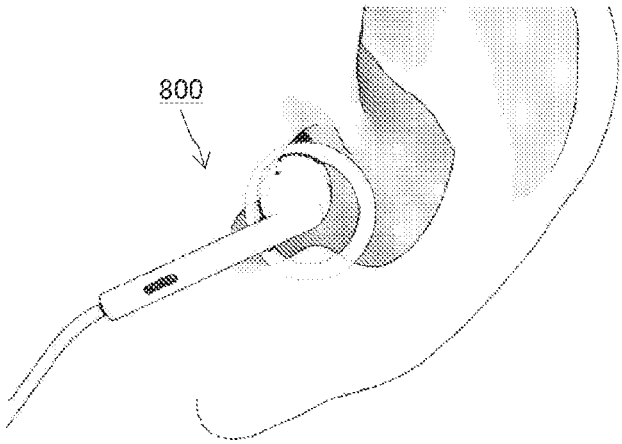
FIG. 12 is a diagram illustrating a state in which the sound output device 800 is worn on the left ear of a user.

FIG. 12 shows a state in which the sound output device 800 is worn on the left ear of the user. It should be understood that, even in a case where the sound generation part 810 is configured integrally with the holding part 820, the entire sound output device 800 can fit in the cavum concha of the user because the sound generation part 810 is small with a diameter of approximately 6 millimeters.

In the example shown in FIG. 12, the holding part 820 having a hollow structure with an O-shape is inserted into the cavum concha together with the integrated sound generation part 810, and is in contact with the bottom surface of the cavum concha. The holding part 820 may have a C-shape. In addition, the duct 830 coupled to the rear surface of the housing of the sound generation part 810 extends across the valley of the intertragic notch. The holding part 820 is locked to the intertragic notch or the inner wall of the tragus so that the duct 830 is hooked on the valley of the intertragic notch. Thereby, the sound output device 800 suitably fits in the auricle.

The holding part 820 is, for example, approximately 13.5 millimeters in dimension and can fit in the cavum concha of the user. Although the size of the cavum concha varies from person to person, if the outer diameter (or width) of the holding part 820 is set to be larger than 16 millimeters, then many people are not able to insert the holding part 820 into the cavum concha.

In addition, it is preferable that the inner diameter of the duct 830 be as large as possible, in view of an object to insert the signal line 840 therethrough and an object to emit an unnecessary sound (sound, generated in the back cavity, having a phase opposite to that of the front cavity) to the outside of the housing of the sound generation part 810. Meanwhile, as shown in FIG. 12, the duct 830 extends across the valley of the intertragic notch. Therefore, if the outer diameter of the duct 830 is set to be greater than or equal to the gap of the intertragic notch (for example, 3.6 millimeters), then the valley of the intertragic notch is widened, which causes concern that the ear of the user is given a pressing feeling.

As shown in FIG. 12, in a state where the holding part 820 inserted into the cavum concha is locked to the intertragic notch or the inner wall of the tragus, the sound output hole 811 drilled on the front surface of the housing of the sound generation part 810 is oriented toward the entrance of the ear canal, which is hidden in FIG. 12.

The sound generated in the sound generation element of the sound generation part 810 is emitted, toward the depth of the ear canal, from the sound output hole 811 drilled on the front surface of the housing of the sound generation part 810, and then the sound reaches the eardrum.

The holding part 820 has a hollow structure, and almost all of the inner side thereof is an opening portion through which to transmit the sound. In addition, since being integrated with a part of the holding part 820, the housing of the sound generation part 810 does not interfere at all with the opening portion of the inner side of the holding part 820. Thus, even in a state where the entire sound output device 800 is inserted into the cavum concha, the ear cavity of the user is not closed. It can be therefore said that the ear cavity of the user is open, the sound output device 800 is of an ear cavity open type, and has a sound transmission performance.

Since the sound generation part 810 is disposed in the cavum concha, a sufficient sound quality can be obtained in the sound output hole 811 drilled on the front surface of the housing even if the output of the sound generation part 810 is reduced. It is therefore possible to prevent leakage of the sound generated in the sound generation part 810 to the outside.

In addition, the directivity of the aerial vibration emitted from the sound output hole 811 also contributes to prevention of sound leakage. The aerial vibration is emitted from the sound output hole 811 toward the inside of the ear canal. The ear canal is a cylindrical closed space of an S-shaped curve, and typically has a length of approximately 25 to 30 millimeters. The aerial vibration emitted from the sound output hole 811 toward the depth of the ear canal reaches the eardrum with the directivity, and the aerial vibration is partly reflected. In addition, since the sound pressure of the aerial vibration increases in the ear canal, the sensitivity (gain) of, particularly, a low frequency range is improved. On the other hand, the outside of the ear canal, namely, the external environment, is an open space. Thus, in a case where the aerial vibration emitted from the sound output hole 811 to the outside of the ear canal is released to the external environment, the aerial vibration does not have the directivity and is steeply attenuated. In a state where the holding part 820 is locked to the intertragic notch, it is preferable that the sound output hole 811 face the cavum concha rather than the vicinity of the entrance of the ear canal.

The characteristics of the ear cavity open type sound output device are summarized. The following characteristics apply to both of the sound output device 100 shown in FIG. 1 to FIG. 4 and the sound output device 800 shown in FIG. 8 to FIG. 11.

(1) The user can hear the ambient sound naturally even while the user wears the sound output device. This allows the user to normally use the functions of human depending on auditory characteristics, such as space perception, danger sensing, and perception of conversation and subtle nuance of conversation.

(2) The sound output device does not close the ear cavity when being worn, which makes another person feel free to speak to the user. In addition, the user wearing the sound output device can constantly hear the ambient sound. Thus, if a person approaches the user, then the user takes, on the basis of sound information such as footsteps of the person, at least passive behavior, as nature of human, such as "turning the body to the direction of the sound", "turning his/her eyes toward the direction of the sound", or the like. Such behavior gives another person an impression of being "welcomed to speak to"; therefore communication between people is not inhibited.

(3) The sound output device is not influenced by a self-generated noise. In the fitting state in the ear cavity, the other tip of the sound guide part, which is the sound output hole, is away from the inner wall of the ear canal. Thus, there is no influence of the user's own voice, heartbeat sound, chewing sound, sound when swallowing saliva, blood flow sound, breath sound, vibration sound transmitted through the body during walking, rustling sound of clothes by cord, and the like. In addition, no friction sound is generated between the earpiece and the inner wall of the ear canal. In addition, since the ear cavity is open, there is no concern about dampness in the ear canal.

(4) The sound output device has favorable fitting in the ear, and can absorb positioning variations due to, for example, individual differences in size and shape of the ears. The holding part is configured to engage with the intertragic notch and to hold so that the sound output hole at the other tip of the sound guide part is oriented toward the depth side of the ear canal. This eliminates the need for length adjustment unlike the case of a behind-the-ear sound output device with a sound guide member folded back at the helix. In addition, the engagement of the holding part with the intertragic notch can maintain the favorable fitting state. In addition, the entirety of the sound output device is configured to fit in the cavum concha of the user, which does not cause the sound output device to interfere with other devices such as a pair of glasses, glass-type wearable device, or behind-the-ear device even if the user uses the sound output device together with these devices.

(5) The sound guide part propagates the sound generated in the sound generation part to the vicinity of the entrance of the ear canal in the shortest distance from behind the ear. Therefore, as compared with the behind-the-ear sound output device, the sound loss can be minimized by the shortened length of the sound guide part, and thus, it is possible to obtain a favorable sound quality with the output of the sound generation part made low. As an additional remark, the sound generation part has a high tolerance of dimensions, and can be designed according to the necessary sound band and sound pressure.

Figure 14:
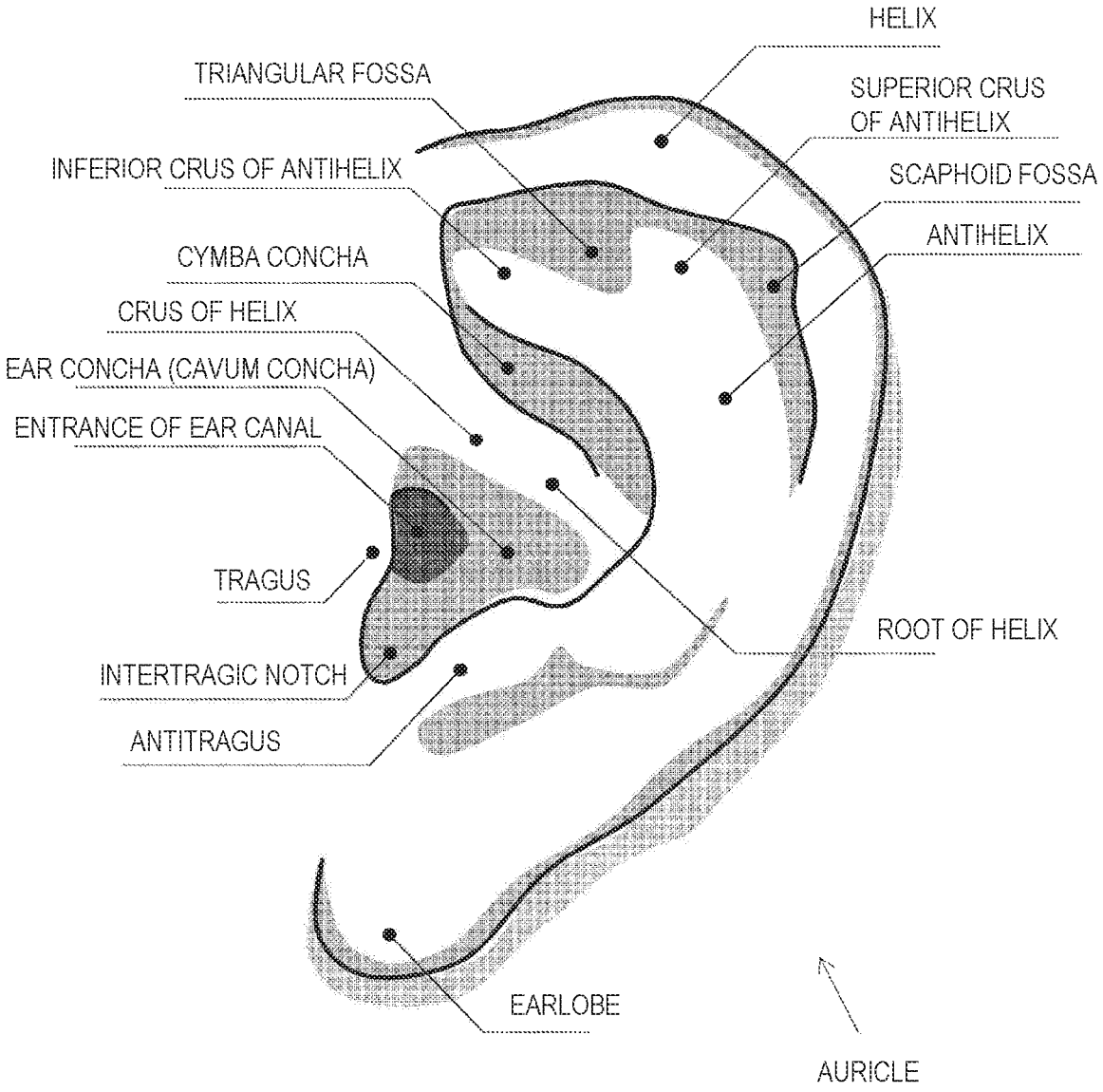
FIG. 14 is a diagram illustrating a structure of an auricle.

For reference, the structure of the auricle is described with reference to FIG. 14. Broadly speaking, the structure of the auricle includes, in order from the outside, the helix, antihelix, ear concha, and tragus. In addition, on the outside of the tragus, the antitragus is present which is a projection to be paired with the tragus. A notch between the tragus and the antitragus is the intertragic notch. In addition, the lower end of the auricle is the earlobe.

The helix is a portion which forms the contour of the ear at the outermost periphery of the ear. The helix curves inward in the vicinity of the center of the auricle (the vicinity of the upper part of the entrance of the ear canal), and then, extends substantially horizontally in the vicinity of the center of the auricle to form a protrusion which vertically separates the ear concha. The crus of helix is the vicinity where the helix curves toward the inside of the auricle. The root of helix is a portion where the crus of helix 306 further enters the ear concha.

The antihelix is a ridge line extending upward from the antitragus, and also corresponds to the rim of the ear concha. The ridge line forming the antihelix is bifurcated, and the upper branch is called the superior crus of antihelix which corresponds to the upper side of the triangular fossa. Further, the lower branch is called the inferior crus of antihelix which corresponds to the lower side of the triangular fossa.

The ear concha is the most recessed portion at the center of the ear, and is separated, with respect to the root of helix, into the cymba concha which is an elongated recess in the upper half and the cavum concha in the lower half. In addition, there is the entrance of the ear canal in the vicinity of the tragus of the cavum concha.

The triangular fossa is a triangular recess with three sides of the superior crus of antihelix, the inferior crus of antihelix, and the helix. In addition, the scaphoid fossa is a recess between the antihelix and the helix, and a recess at the outer upper portion in terms of the entire auricle.

INDUSTRIAL APPLICABILITY

The technology disclosed in the present specification has been described in detail above with reference to the specific embodiment. However, it will be obvious to those skilled in the art that modification and replacement of the embodiment can be made without departing from the scope of the technology disclosed in the present specification.

The sound output device to which the technology disclosed in the present specification is applied is worn on an ear of a user and used, as with so-called earphones. The sound output device to which the technology disclosed in the present specification is applied has the following features: the sound output device can implement listening characteristic of an ambient sound, even in the fitting state, equivalent to that in a non-fitting state, and output sound information at the same time; and the ear cavity of the user appears not to be closed to the people around even in the fitting state. By taking advantage of such features, the sound output device to which the technology disclosed in the present specification is applied can be used in the fields of various indoor and outdoor sports (during play, remote coaching, and so on) such as walking, jogging, cycling, mountain climbing, skiing, snowboarding, and the like, and the fields of communication or presentation which involves hearing an ambient sound and presenting audio information at the same time (for example, supplementary information at the time of watching a play, audio information presentation in museums, bird watching (cry listening), and the like), driving or navigation, security guards, newscasters, and the like.

In short, the technology disclosed in the present specification has been described in an illustrative form, and the description of the present specification should not be interpreted in a limited manner. The claims should be taken into account to judge the gist of the technology disclosed in the present specification.

Additionally, the present technology may also be configured as below.

(1)

A sound output device including:

a sound generation part; and a holding part that includes a sound transmission part and is configured to hold the sound generation part in a vicinity of an entrance of an ear canal of a user.

(2)

The sound output device according to (1), in which the sound transmission part includes a structure having an opening portion, and a housing of the sound generation part is integrated with a part of the structure having the opening portion.

(3)

The sound output device according to (2), in which the housing of the sound generation part joins with an inner surface of the structure having the opening portion.

(4)

The sound output device according to any of (1) to (3), in which the holding part engages with an intertragic notch of the user.

(5)

The sound output device according to any of (1) to (4), in which the sound generation part includes a sound generation element having a dynamic type driver.

(6)

The sound output device according to any of (1) to (5), including a hollow exhaust part joining with a rear surface of a housing of the sound generation part.

(7)

The sound output device according to (6), in which the exhaust part extends from a rear surface side of the housing across an intertragic notch and has an exhaust hole outside an auricle.

(8)

The sound output device according to (6) or (7), including a signal line inserted through the exhaust part.

(9)

The sound output device according to any of (1) to (8), including a sound guide part that protrudes from a front surface of a housing of the sound generation part and has a tip serving as a sound output hole.

(10)

The sound output device according to any of (1) to (8), including a sound output hole drilled on a front surface of a housing of the sound generation part.

REFERENCE SIGNS LIST

100 sound output device
110 sound generation part
111 sound guide part
120 holding part
130 signal line
501 magnet
502 voice coil
503 diaphragm
506 exhaust part
800 sound output device
810 sound generation part
811 sound output hole
820 holding part
830 duct
831 exhaust hole
840 signal line

The invention claimed is:

1. A sound output device, comprising:

a sound generation part; and a holding part configured to hold the sound generation part in a vicinity of an entrance of an ear canal of a user, wherein the holding part includes a sound transmission part, the holding part has one of a closed ring shape or an open C-shape, a housing of the sound generation part is in contact with a first part of an inner surface of the holding part, the sound transmission part is an opening portion that comprises a second part of the inner surface of the holding part and the housing of the sound generation part, and the first part of the inner surface of the holding part is different from the second part of the inner surface of the holding part.

2. The sound output device according to claim 1, wherein the holding part is configured to engage with an intertragic notch of the user.

3. The sound output device according to claim 1, wherein the sound generation part includes a sound generation element having a dynamic type driver.

4. The sound output device according to claim 1, further comprising a hollow exhaust part configured to integrate with a rear surface of the housing of the sound generation part.

5. The sound output device according to claim 4, wherein the hollow exhaust part extends from a rear surface side of the housing across an intertragic notch of the user, and the hollow exhaust part has an exhaust hole outside an auricle of the user.

6. The sound output device according to claim 4, further comprising a signal line inserted through the hollow exhaust part.

7. The sound output device according to claim 1, further comprising a sound guide part that protrudes from a front surface of the housing of the sound generation part, wherein the sound guide part has a tip, and an opening portion at the tip of the sound guide part is a sound output hole.

8. The sound output device according to claim 1, further comprising a sound output hole on a front surface of the housing of the sound generation part.

* * * * *